US006106694A

United States Patent [19]

Kalnes et al.

[11] Patent Number: 6,106,694

[45] Date of Patent: Aug. 22, 2000

[54] HYDROCRACKING PROCESS

[75] Inventors: Tom N. Kalnes, La Grange; Vasant P. Thakkar, Elk Grove Village, both of Ill.

[73] Assignee: Uop LLC, Des Plaines, Ill.

[21] Appl. No.: 09/163,156

[22] Filed: Sep. 29, 1998

[51] Int. Cl.[7] ..... C10G 45/00

[52] U.S. Cl. ..... 208/57; 208/59

[58] Field of Search ..... 208/57, 59, 58

[56] References Cited

U.S. PATENT DOCUMENTS

| | | | |
|---|---|---|---|
| 4,243,519 | 1/1981 | Schorfeide | 208/59 |
| 4,720,337 | 1/1988 | Graziani et al. | 208/58 |
| 4,950,384 | 8/1990 | Groenveld | 208/59 |
| 4,954,241 | 9/1990 | Kukes et al. | 208/59 |
| 5,705,052 | 1/1998 | Gupta | 208/57 |
| 5,720,872 | 2/1998 | Grupta | 208/57 |

*Primary Examiner*—Helane E. Myers
*Attorney, Agent, or Firm*—John G. Tolomei; John G. Cutts, Jr.

[57] ABSTRACT

A hydrocracking process wherein a hydrocarbonaceous feedstock and a hot hydrocracking zone effluent containing hydrogen is passed to a denitrification and desulfurization reaction zone to produce hydrogen sulfide and ammonia to thereby clean up the fresh feedstock. The resulting hot, uncooled effluent from the denitrification and desulfurization zone is hydrogen stripped in a stripping zone maintained at essentially the same pressure as the preceding reaction zone with a hydrogen-rich gaseous stream to produce a vapor stream comprising hydrogen, hydrocarbonaceous compounds boiling at a temperature below the boiling range of the fresh feedstock, hydrogen sulfide and ammonia, and a liquid hydrocarbonaceous stream.

12 Claims, 1 Drawing Sheet

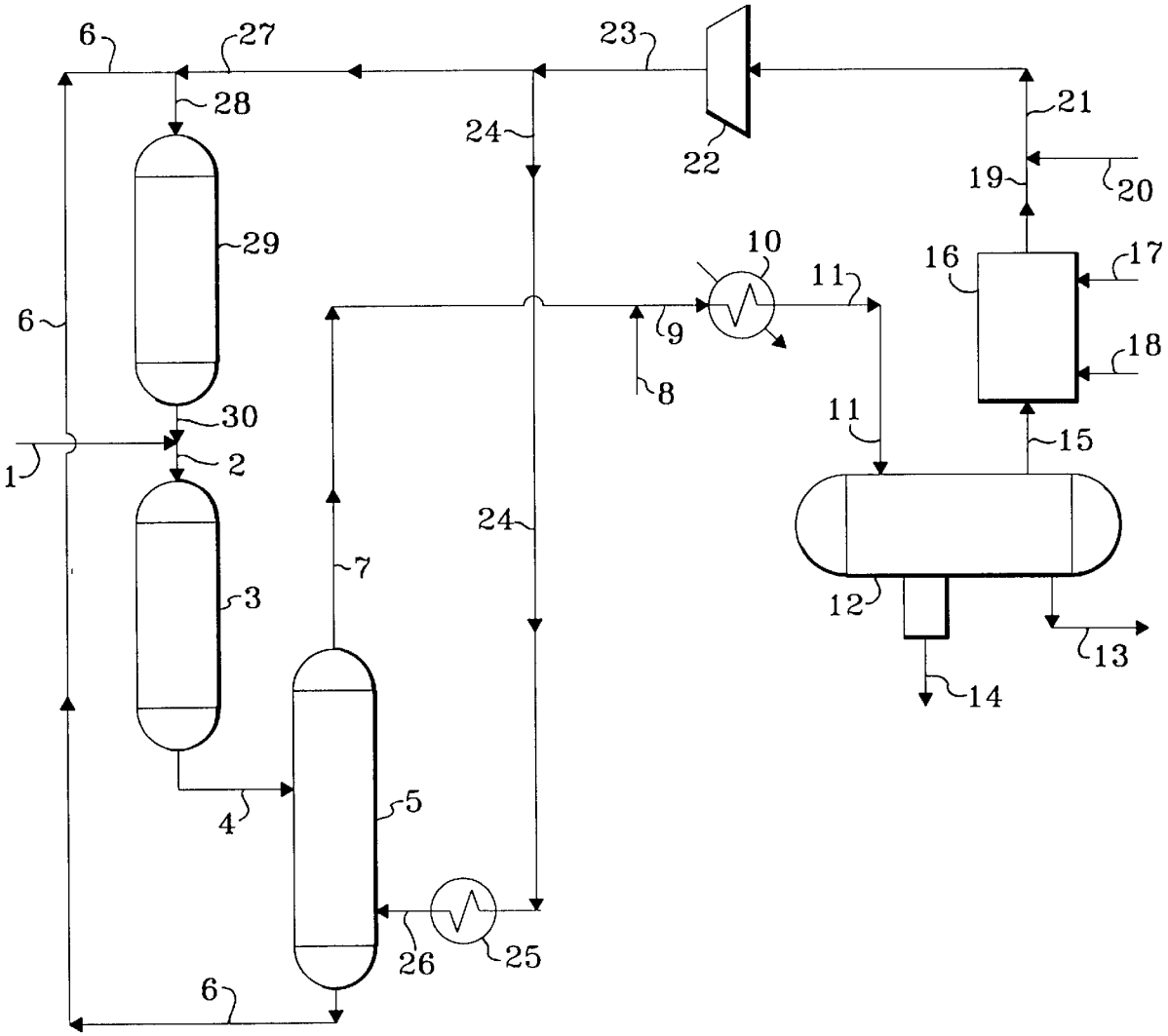
1
2
3
4
5
6
6
6
7
8
9
10
11
11
12
13
14
15
16
17
18
19
20
21
22
23
24
24
25
26
27
28
29
30

HYDROCRACKING PROCESS

BACKGROUND OF THE INVENTION

The field of art to which this invention pertains is the hydrocracking of a hydrocarbonaceous feedstock. Petroleum refiners often produce desirable products such as turbine fuel, diesel fuel and other products known as middle distillates as well as lower boiling hydrocarbonaceous liquids such as naphtha and gasoline by hydrocracking a hydrocarbon feedstock derived from crude oil, for example. Feedstocks most often subjected to hydrocracking are gas oils and heavy gas oils recovered from crude oil by distillation. A typical heavy gas oil comprises a substantial portion of hydrocarbon components boiling above about 700° F., usually at least about 50 percent by weight boiling above 700° F. A typical vacuum gas oil normally has a boiling point range between about 600° F. and about 1050° F.

Hydrocracking is generally accomplished by contacting in a hydrocracking reaction vessel or zone the gas oil or other feedstock to be treated with a suitable hydrocracking catalyst under conditions of elevated temperature and pressure in the presence of hydrogen so as to yield a product containing a distribution of hydrocarbon products desired by the refiner. The operating conditions and the hydrocracking catalysts within a hydrocracking reactor influence the yield of the hydrocracked products.

Although a wide variety of process flow schemes, operating conditions and catalysts have been used in commercial activities, there is always a demand for new hydrocracking methods which provide lower costs and higher liquid product yields. It is generally known that enhanced product selectivity can be achieved at lower conversion per pass (60% to 90% conversion of fresh feed) through the catalytic hydrocracking zone. However, it was previously believed that any advantage of operating at below about 60% conversion per pass was negligible or would only see diminishing returns. Low conversion per pass is generally more expensive, however, the present invention greatly improves the economic benefits of a low conversion per pass process and demonstrates the unexpected advantages.

INFORMATION DISCLOSURE

U.S. Pat. No. 5,720,872 discloses a process for hydroprocessing liquid feedstocks in two or more hydroprocessing stages which are in separate reaction vessels and wherein each reaction stage contains a bed of hydroprocessing catalyst. The liquid product from the first reaction stage is sent to a low pressure stripping stage and stripped of hydrogen sulfide, ammonia and other dissolved gases. The stripped product stream is then sent to the next downstream reaction stage, the product from which is also stripped of dissolved gases and sent to the next downstream reaction stage until the last reaction stage, the liquid product of which is stripped of dissolved gases and collected or passed on for further processing. The flow of treat gas is in a direction opposite the direction in which the reaction stages are staged for the flow of liquid. Each stripping stage is a separate stage, but all stages are contained in the same stripper vessel.

International Publication No. WO 97/38066 (PCT/US 97/04270) discloses a process for reverse staging in hydroprocessing reactor systems.

U.S. Pat. No. 3,328,290 (Hengstebech) discloses a two-stage process for the hydrocracking of hydrocarbons in which the feed is pretreated in the first stage.

BRIEF SUMMARY OF THE INVENTION

The present invention is a catalytic hydrocracking process which provides higher liquid product yields, specifically higher yields of turbine fuel and diesel oil. The process of the present invention provides the yield advantages associated with a low conversion per pass operation without compromising unit economics. Other benefits of a low conversion per pass operation include the elimination of the need for inter-bed hydrogen quench and the minimization of the fresh feed pre-heat since the higher flow rate of recycle liquid will provide additional process heat to initiate the catalytic reaction and an additional heat sink to absorb the heat of reaction. An overall reduction in fuel gas and hydrogen consumption, and light ends production may also be obtained. Finally, the low conversion per pass operation requires less catalyst volume.

In accordance with one embodiment the present invention relates to a process for hydrocracking a hydrocarbonaceous feedstock which process comprises: (a) passing a hydrocarbonaceous feedstock, a hydrocracking zone effluent and hydrogen to a denitrification and desulfurization reaction zone with a catalyst and recovering a denitrification and desulfurization reaction zone effluent therefrom; (b) passing the denitrification and desulfurization reaction zone effluent directly to a hot, high pressure stripper utilizing a hot hydrogen-rich stripping gas to produce a first vapor stream comprising hydrogen, hydrocarbonaceous compounds boiling at a temperature below the boiling range of the hydrocarbonaceous feedstock, hydrogen sulfide and ammonia, and a first liquid stream comprising hydrocarbonaceous compounds boiling in the range of the hydrocarbonaceous feedstock; (c) passing at least a portion of the first liquid stream comprising hydrocarbonaceous compounds boiling in the range of the hydrocarbonaceous feedstock and hydrogen to a hydrocracking zone containing a hydrocracking catalyst and recovering a hydrocracking zone effluent therefrom; (d) passing the hydrocracking zone effluent to the denitrification and desulfurization reaction zone; and (e) recovering at least a portion of the hydrocarbonaceous compounds boiling at a temperature below the boiling range of the hydrocarbonaceous feedstock from step (b).

Other embodiments of the present invention encompass further details such as types and descriptions of feedstocks, hydrocracking catalysts and preferred operating conditions including temperatures and pressures, all of which are hereinafter disclosed in the following discussion of each of these facets of the invention.

BRIEF DESCRIPTION OF THE DRAWING

The drawing is a simplified process flow diagram of a preferred embodiment of the present invention. The drawing is intended to be schematically illustrative of the present invention and not be a limitation thereof.

DETAILED DESCRIPTION OF THE INVENTION

It has been discovered that higher liquid product yields and a lower cost of production can be achieved and enjoyed in the above-described hydrocracking process.

The process of the present invention is particularly useful for hydrocracking a hydrocarbon oil containing hydrocarbons and/or other organic materials to produce a product containing hydrocarbons and/or other organic materials of lower average boiling point and lower average molecular weight. The hydrocarbon feedstocks that may be subjected to hydrocracking by the method of the invention include all mineral oils and synthetic oils (e.g., shale oil, tar sand products, etc.) and fractions thereof. Illustrative hydrocarbon feedstocks include those containing components boiling above 550° F., such as atmospheric gas oils, vacuum gas oils, deasphalted, vacuum, and atmospheric residua, hydrotreated or mildly hydrocracked residual oils, coker distillates, straight run distillates, solvent-deasphalted oils, pyrolysis-derived oils, high boiling synthetic oils, cycle oils and cat cracker distilllates. A preferred hydrocracking feedstock is a gas oil or other hydrocarbon fraction having at least 50% by weight, and most usually at least 75% by weight, of its components boiling at temperatures above the end point of the desired product, which end point, in the case of heavy gasoline, is generally in the range from about 380° F. to about 420° F. One of the most preferred gas oil feedstocks will contain hydrocarbon components which boil above 550° F. with best results being achieved with feeds containing at least 25 percent by volume of the components boiling between 600° F. and 1000° F.

Also included are petroleum distillates wherein at least 90 percent of the components boil in the range from about 300° F. to about 800° F. The petroleum distillates may be treated to produce both light gasoline fractions (boiling range, for example, from about 50° F. to about 185° F.) and heavy gasoline fractions (boiling range, for example, from about 185° F. to about 400° F.). The present invention is particularly suited for the production of increased amounts of middle distillate products.

The selected feedstock is first introduced into a denitrification and desulfurization reaction zone together with a hot hydrocracking zone effluent at hydrotreating reaction conditions. Preferred denitrification and desulfurization reaction conditions or hydrotreating reaction conditions include a temperature from about 400° F. to about 900° F., a pressure from about 500 psig to about 2500 psig, a liquid hourly space velocity of the fresh hydrocarbonaceous feedstock from about 0.1 $hr^{-1}$ to about 10 $hr^{-1}$ with a hydrotreating catalyst or a combination of hydrotreating catalysts.

The term "hydrotreating" as used herein refers to processes wherein a hydrogen-containing treat gas is used in the presence of suitable catalysts which are primarily active for the removal of heteroatoms, such as sulfur and nitrogen and for some hydrogenation of aromatics. Suitable hydrotreating catalysts for use in the present invention are any known conventional hydrotreating catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable hydrotreating catalysts include zeolitic catalysts, as well as noble metal catalysts where the noble metal is selected from palladium and platinum. It is within the scope of the present invention that more than one type of hydrotreating catalyst be used in the same reaction vessel. The Group VIII metal is typically present in an amount ranging from about 2 to about 20 weight percent, preferably from about 4 to about 12 weight percent. The Group VI metal will typically be present in an amount ranging from about 1 to about 25 weight percent, preferably from about 2 to about 25 weight percent. Typical hydrotreating temperatures range from about 400° F. to about 900° F. with pressures from about 500 psig to about 2500 psig, preferably from about 500 psig to about 2000 psig.

The resulting effluent from the denitrification and desulfurization reaction zone is transferred without intentional heat-exchange (uncooled) and is introduced into a hot, high pressure stripping zone maintained at essentially the same pressure as the denitrification and desulfurization reaction zone, and contacted and countercurrently stripped with a hydrogen-rich gaseous stream to produce a first gaseous hydrocarbonaceous stream containing hydrocarbonaceous compounds boiling at a temperature less than about 700° F., hydrogen sulfide and ammonia, and a first liquid hydrocarbonaceous stream containing hydrocarbonaceous compounds boiling at a temperature greater than about 700° F. The stripping zone is preferably maintained at a temperature in the range from about 450° F. to about 875° F. The effluent from the denitrification and desulfurization reaction zone is not substantially cooled prior to stripping and would only be lower in temperature due to unavoidable heat loss during transport from the reaction zone to the stripping zone. It is preferred that any cooling of the denitrification and desulfurization reaction zone effluent prior to stripping is less than about 100° F. By maintaining the pressure of the stripping zone at essentially the same pressure as the denitrification and desulfurization reaction zone is meant that any difference in pressure is due to the pressure drop required to flow the effluent stream from the reaction zone to the stripping zone. It is preferred that the pressure drop is less than about 100 psig. The hydrogen-rich gaseous stream is preferably supplied to the stripping zone in an amount greater than about 1 weight percent of the hydrocarbonaceous feedstock.

At least a portion of the first liquid hydrocarbonaceous stream containing hydrocarbonaceous compounds boiling at a temperature greater than about 700° F. recovered from the stripping zone is introduced into a hydrocracking zone along with added hydrogen. The hydrocracking zone may contain one or more beds of the same or different catalyst. In one embodiment, when the preferred products are middle distillates, the preferred hydrocracking catalysts utilize amorphous bases or low-level zeolite bases combined with one or more Group VIII or Group VIB metal hydrogenating components. In another embodiment, when the preferred products are in the gasoline boiling range, the hydrocracking zone contains a catalyst which comprises, in general, any crystalline zeolite cracking base upon which is deposited a minor proportion of a Group VIII metal hydrogenating component. Additional hydrogenating components may be selected from Group VIB for incorporation with the zeolite base. The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and 14 Angstroms ($10^{-10}$ meters). It is preferred to employ zeolites having a relatively high silica/alumina mole ratio between about 3 and 12. Suitable zeolites found in nature include, for example, mordenite, stilbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8–12 Angstroms ($10^{-10}$ meters), wherein the silica/alumina mole ratio is about 4 to 6. A prime example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water.

Hydrogen or "decationized" Y zeolites of this nature are more particularly described in U.S. Pat. No. 3,130,006.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. The preferred cracking bases are those which are at least about 10 percent, and preferably at least 20 percent, metal-cation-deficient, based on the initial ion-exchange capacity. A specifically desirable and stable class of zeolites are those wherein at least about 20 percent of the ion exchange capacity is satisfied by hydrogen ions.

The active metals employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and 30 percent by weight may be used. In the case of the noble metals, it is normally preferred to use about 0.05 to about 2 weight percent. The preferred method for incorporating the hydrogenating metal is to contact the zeolite base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of, e.g., 700°–1200° F. (371°–648° C.) in order to activate the catalyst and decompose ammonium ions. Alternatively, the zeolite component may first be pelleted, followed by the addition of the hydrogenating component and activation by calcining. The foregoing catalysts may be employed in undiluted form, or the powdered zeolite catalyst may be mixed and copelleted with other relatively less active catalysts, diluents or binders such as alumina, silica gel, silica-alumina cogels, activated clays and the like in proportions ranging between 5 and 90 weight percent. These diluents may be employed as such or they may contain a minor proportion of an added hydrogenating metal such as a Group VIB and/or Group VIII metal.

Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718 (Klotz).

The hydrocracking of the hydrocarbonaceous feedstock in contact with a hydrocracking catalyst is conducted in the presence of hydrogen and preferably at hydrocracking reactor conditions which include a temperature from about 450° F. (232° C.) to about 875° F. (468° C.), a pressure from about 500 psig (3448 kPa gauge) to about 3000 psig (20685 kPa gauge), a liquid hourly space velocity (LHSV) from about 0.1 to about 30 $hr^{-1}$, and a hydrogen circulation rate from about 2000 (337 normal $m^3/m^3$) to about 25,000 (4200 normal $m^3/m^3$) standard cubic feet per barrel. In accordance with the present invention, the term "substantial conversion to lower boiling products" is meant to connote the conversion of at least 5 volume percent of the fresh feedstock. In a preferred embodiment, the per pass conversion in the hydrocracking zone is in the range from about 15% to about 45%. More preferably the per pass conversion is in the range from about 20% to about 40%.

The resulting first gaseous hydrocarbonaceous stream containing hydrocarbonaceous compounds boiling at a temperature less than about 700° F., hydrogen, hydrogen sulfide and ammonia from the stripping zone is preferably cooled to a temperature in the range from about 40° F. to about 140° F. and at least partially condensed to produce a second liquid hydrocarbonaceous stream which is recovered and fractionated to produce desired hydrocarbon product streams and to produce a second hydrogen-rich gaseous stream which is bifurcated to provide at least a portion of the added hydrogen introduced into the hydrocracking zone as hereinabove described and at least a portion of the first hydrogen-rich gaseous stream introduced in the stripping zone. Fresh make-up hydrogen may be introduced into the process at any suitable and convenient location but is preferably introduced into the stripping zone. Before the second hydrogen-rich gaseous stream is introduced into the hydrocracking zone, it is preferred that at least a significant portion, at least about 90 weight percent, for example, of the hydrogen sulfide is removed and recovered by means of known, conventional methods. In a preferred embodiment, the hydrogen-rich gaseous stream introduced into the hydrocracking zone contains less than about 50 wppm hydrogen sulfide.

DETAILED DESCRIPTION OF THE DRAWING

In the drawing, the process of the present invention is illustrated by means of a simplified schematic flow diagram in which such details as pumps, instrumentation, heat-exchange and heat-recovery circuits, compressors and similar hardware have been deleted as being non-essential to an understanding of the techniques involved. The use of such miscellaneous equipment is well within the purview of one skilled in the art.

With reference now to the drawing, a feed stream comprising vacuum gas oil and heavy coker gas oil is introduced into the process via line 1 and admixed with a hereinafter-described effluent from hydrocracking zone 29 transported via line 30. The resulting admixture is transported via line 2 into hydrotreating zone 3. The resulting effluent from hydrotreating zone 3 is transported via line 4 and introduced into stripping zone 5. A vaporous stream containing hydrocarbons and hydrogen passes upward in stripping zone 5 and is removed from stripping zone 5 via line 7 and line 9 and introduced into heat-exchanger 10. A liquid hydrocarbonaceous stream is removed from stripping zone 5 via line 6 and is introduced into hydrocracking zone 29 via line 6 and line 28. The resulting cooled effluent from heat-exchanger 10 is transported via line 11 and introduced into vapor-liquid separator 12. A hydrogen-rich gaseous stream containing acid gas compounds is removed from vapor-liquid separator 12 via line 15 and is introduced into acid gas recovery zone 16. A lean solvent is introduced via line 17 into acid gas recovery zone 16 and contacts the hydrogen-rich gaseous stream in order to dissolve an acid gas. A rich solvent containing acid gas is removed from acid gas recovery zone 16 via line 18 and recovered. A hydrogen-rich gaseous stream containing a reduced concentration of acid gas is removed from acid gas recovery zone 16 via line 19 and is admixed with fresh make-up hydrogen which is introduced via line 20. The resulting admixture is transported via line 21 and is introduced into compressor 22. A resulting compressed hydrogen-rich gaseous stream is transported via line 23 and at least a portion is recycled via line 27 and line 28 to hydrocracking zone 29. Another portion of the hydrogen-rich gaseous stream is transported via line 24 and is introduced into heat-exchanger 25. The resulting heated hydrogen-rich gaseous stream is removed from heat-exchanger 25 via line 26 and is introduced into stripping zone 5. An aqueous stream is introduced via line 8 and contacts the flowing stream in line 9 and is subsequently introduced into vapor-liquid separator 12 as hereinabove described. An aqueous stream containing water-soluble salts is removed from vapor-liquid separator 12 via line 14 and recovered. A liquid stream containing hydrocarbonaceous compounds is removed from vapor-liquid separator 12 via line 13 and recovered.

ILLUSTRATIVE EMBODIMENT

The process of the present invention is further demonstrated by the following illustrative embodiment. This illustrative embodiment is, however, not presented to unduly limit the process of this invention, but to illustrate the advantage of the hereinabove-described embodiment. All of the following data were not obtained by the actual performance of the present invention but are considered prospective and reasonably illustrative of the expected performance of the invention.

A portion of a hydrocracker feedstock having the characteristics presented in Table 1 is hydrocracked in a conventional single stage hydrocracker at operating conditions presented in Table 2 to yield the products described in Table 3. Another portion of the same hydrocracker feedstock is hydrocracked in a hydrocracker of the present invention using the same type of catalyst as the base case at operating conditions presented in Table 2 to yield the products described in Table 3. Yields are calculated based on fresh feed at start of run conditions.

TABLE 1

HYDROCRACKER FEEDSTOCK ANALYSIS
80/20 Blend Straight Run Vacuum Gas Oil-Coker Gas Oil

| | | |
|---|---|---|
| Gravity, ° API | 21 | |
| Distillation, Volume Percent | | |
| IBP, ° F. (° C.) | 664 | (351) |
| 10 | 716 | (379) |
| 30 | 767 | (408) |
| 50 | 817 | (436) |
| 70 | 880 | (471) |
| 90 | 965 | (518) |
| FBP | 1050 | (565) |
| Sulfur, weight percent | 3.01 | |
| Nitrogen, PPM | 1256 | |
| Bromine Number | 7.5 | |
| Heptane Insolubles, weight percent | <0.05 | |
| Conradson Carbon, weight percent | 0.36 | |
| Nickel and Vanadium, PPM | 0.4 | |

TABLE 2

SUMMARY OF OPERATING CONDITIONS

| Flowscheme | Base Case | Low Conversion Per Pass with Improved Yields |
|---|---|---|
| Reactor Operating Conditions | | |
| High Pressure Separator Pressure, psig | 2300 | 1700 |
| Liquid Hourly Space Velocity | | |
| Hydrotreating Zone | 2.18 | 1.13 |

TABLE 2-continued

SUMMARY OF OPERATING CONDITIONS

| Flowscheme | Base Case | Low Conversion Per Pass with Improved Yields |
|---|---|---|
| Hydrocracking Zone | 0.93 | 3.0 |
| Overall | 0.65 | 0.82 |
| Combined Feed Ratio | **1.5 | ***3.0 |
| $H_2$/Fresh Feed, SCFB | 11,000 | 11,000 |
| Conversion, Per Pass*, % | 60 | 30 |
| Total (Gross) Conversion, %* | 100 | 100 |
| Number of Gas Quench Points | 3 | 0 |
| Maximum Reactor ΔT, ° F. HT/HC | 50/30 | 60/50 |

*Conversion to 720° F. End Point Distillate and Lighter
**Recycle Liquid to HT first then to HC
***Recycle Liquid to HC first then to HT

TABLE 3

PRODUCT YIELDS

| | Base Case | | Invention | |
|---|---|---|---|---|
| | Wt. % | Vol. % | Wt. % | Vol. % |
| $NH_3$ | 0.15 | | 0.15 | |
| $H_2S$ | 3.20 | | 3.20 | |
| $C_1$—$C_4$ | 3.68 | | 2.97 | |
| Light Naphtha ($C_5$—$C_6$) | 6.32 | 8.76 | 5.08 | 7.04 |
| Heavy Naphtha ($C_7$-260° F.) | 10.38 | 12.87 | 7.68 | 9.52 |
| Kerosine (260° F.–550° F.) | 50.16 | 58.15 | 48.34 | 55.92 |
| Diesel (550° F.–720° F.) | 28.72 | 31.98 | 35.11 | 39.09 |
| Total Middle Distillate | 78.88 | 90.13 | 83.45 | 95.01 |
| $C_{5+}$ Total | 95.58 | 111.76 | 96.21 | 111.57 |
| $C_{4+}$ Total | 98.20 | 116.01 | 98.32 | 115.00 |
| Chemical $H_2$ Consumption (SCFB) | 2.61 | 1600 | 2.53 | 1550 |

From the above tables it is apparent that the present invention is able to operate at a pressure of 1700 psig or approximately one fourth less than the base case, utilizes a hydrocracking reactor having about 30% less internal volume as well as about 20% less catalyst inventory. Because of the lower hydrocracking reactor zone operating severity in the present invention, the conversion per pass is reduced from about 60% to about 30%. These enumerated changes used in the present invention provide a lower cost hydrocracking process as well as providing an increased yield of total middle distillate product. The present invention also has a 50 SCFB lower chemical hydrogen consumption and a 50% less hydrogen loss to fuel gas.

The foregoing description, drawing and illustrative embodiment clearly illustrate the advantages encompassed by the process of the present invention and the benefits to be afforded with the use thereof.

What is claimed:

1. A process for hydrocracking a hydrocarbonaceous feedstock which process comprises:

(a) passing a hydrocarbonaceous feedstock, a hydrocracking zone effluent and hydrogen to a denitrification and desulfurization reaction zone at reaction zone conditions including a temperature from about 400° F. to about 900° F., a pressure from about 500 psig to about 2500 psig, and a liquid hourly space velocity of said hydrocarbonaceous feedstock from about 0.1 $hr^{-1}$ to about 10 $hr^{-1}$ with a catalyst and recovering a denitrification and desulfurization reaction zone effluent therefrom;

(b) passing said denitrification and desulfurization reaction zone effluent directly to a hot, high pressure stripper operated at a pressure which is essentially equal to that of said denitrification and desulfurization reaction zone and utilizing a hot hydrogen-rich stripping gas to produce a first vapor stream comprising hydrogen, hydrocarbonaceous compounds boiling at a temperature below the boiling range of said hydrocarbonaceous feedstock, hydrogen sulfide and ammonia, and a first liquid stream comprising hydrocarbonaceous compounds boiling in the range of said hydrocarbonaceous feedstock;

(c) passing at least a portion of said first liquid stream comprising hydrocarbonaceous compounds boiling in the range of said hydrocarbonaceous feedstock and hydrogen to a hydrocracking zone containing a hydrocracking catalyst and operated at a temperature of about 400° F. to about 900° F., a pressure from about 500 psig to about 2500 psig and a liquid hourly space velocity from about 0.1 $hr^{-1}$ to about 15 $hr^{-1}$ and recovering a hydrocracking zone effluent therefrom;

(d) passing said hydrocracking zone effluent to said denitrification and desulfurization reaction zone; and (e) recovering at least a portion of said hydrocarbonaceous compounds boiling at a temperature below the boiling range of said hydrocarbonaceous feedstock from step (b).

2. The process of claim 1 wherein said hydrocarbonaceous feedstock boils in the range from about 450° F. to about 1050° F.

3. The process of claim 1 wherein said hot, high pressure stripper is operated at a temperature and pressure which is essentially equal to that of said dentrification and desulfurization reaction zone effluent.

4. The process of claim 1 wherein said hydrocracking catalyst comprises at least one noble metal.

5. The process of claim 1 wherein said hydrocracking catalyst comprises platinum and palladium.

6. The process of claim 1 wherein said hot, high pressure stripper is operated at a temperature no less than about 100° F. below the outlet temperature of said denitrification and desulfurization reaction zone and at a pressure no less than about 100 psig below the outlet pressure of said denitrification and desulfurization reaction zone.

7. The process of claim 1 wherein said hydrocracking zone is operated without intermediate hydrogen gas quench points.

8. The process of claim 1 wherein said hydrocracking zone is operated at a conversion per pass in the range from about 15% to about 45%.

9. The process of claim 1 wherein said hydrocracking zone is operated at a conversion per pass in the range from about 20% to about 40%.

10. The process of claim 1 wherein said denitrification and desulfurization reaction zone contains at least two different hydrotreating catalysts.

11. The process of claim 1 wherein said denitrification and desulfurization reaction zone contains a catalyst comprising nickel and molybdenum.

12. The process of claim 1 where said hydrogen introduced into said hydrocracking zone contains less than about 50 wppm hydrogen sulfide.

* * * * *